US006243954B1

(12) United States Patent
Bowers

(10) Patent No.: US 6,243,954 B1
(45) Date of Patent: Jun. 12, 2001

(54) CANDLE WICK TRIMMING DEVICE

(76) Inventor: Christopher F. Bowers, 772 E. Providence Rd., Aldan, PA (US) 19018

( * ) Notice: Subject to any disclaimer, the term of this patent is extended or adjusted under 35 U.S.C. 154(b) by 0 days.

(21) Appl. No.: 09/350,587

(22) Filed: Jul. 9, 1999

(51) Int. Cl.[7] ..... B26B 17/00
(52) U.S. Cl. ..... 30/233; 30/254; 30/286
(58) Field of Search ..... 30/112, 134, 233, 30/252, 254, 258, 286

(56) References Cited

U.S. PATENT DOCUMENTS

| | | | | |
|---|---|---|---|---|
| 1,320,777 | * | 11/1919 | Mayhew | 30/258 |
| 1,345,882 | * | 7/1920 | Repass | 30/258 |
| 2,556,559 | * | 6/1951 | Smith | 30/233 |
| 2,557,305 | * | 6/1951 | Morey | 30/258 |
| 2,934,822 | * | 5/1960 | Docken | 30/258 |
| 3,055,244 | * | 9/1962 | Snook | 30/258 |
| 3,159,913 | * | 12/1964 | Winton | 30/258 |
| 3,172,133 | * | 3/1965 | Rizzo | 30/258 |
| 3,541,684 | | 11/1970 | Beaver | 30/124 |
| 3,857,143 | | 12/1974 | Montory et al. | 28/2 |
| 4,271,838 | | 6/1981 | Lasner et al. | 128/318 |
| 4,677,747 | | 7/1987 | Winer | 30/124 |
| 5,398,415 | | 3/1995 | Collins, Jr. | 30/124 |
| 6,076,262 | * | 6/2000 | Pappas | 30/179 |

FOREIGN PATENT DOCUMENTS

2380250 * 10/1978 (FR) .

* cited by examiner

*Primary Examiner*—Rinaldi I. Rada
*Assistant Examiner*—Kim Ngoc Tran
(74) *Attorney, Agent, or Firm*—Henderson & Sturm LLP

(57) ABSTRACT

A trimming device (10 ) for trimming the wick (101 ) at a selected height above the body of a candle (100). The trimming device (10 ) includes a of pair elongated jaw members (20, 30 ) having upper (21, 31 ) and lower (22, 32 ) ends. The lower ends (22, 32 ) are provided with jaw elements (40, 50 ) having cooperating severing surfaces (44, 52 ) which are spaced from the lower ends (22, 32 ) to sever a candle wick (101 ) at a predetermined vertical height above the body of a candle.

4 Claims, 1 Drawing Sheet

CANDLE WICK TRIMMING DEVICE

BACKGROUND OF THE INVENTION

1. Field of the Invention

The present invention relates to the field of specialized cutting implements in general, and in particular to a device for trimming candle wicks at the proscribed height above the top of the unburned portion of a candle.

2. Description of Related Art

As can be seen by reference to the following U.S. Pat. Nos. 3,541,684; 3,857,143; 4,271,838; 4,677,747; and 5,398,415, the prior art is replete with myriad and diverse specialized cutting implements.

While all of the aforementioned prior art constructions are more than adequate for the basic purpose and function for which they have been specifically designed, they are uniformly deficient with respect to their failure to provide a simple, efficient, and practical way of trimming a candle wick to the proscribed height of ¼ inch above the body of the candle prior to lighting the candle.

As most people are aware, candle manufacturers strongly recommend trimming a candle wick to a height of ¼ inch prior to lighting the candle to prevent the candle from being consumed to rapidly, as well as to eliminate the creation of peripheral walls of unconsumed wax surrounding the wick which results from the failure to trim the wick prior to each lighting of the candle.

As a consequence of the foregoing situation, there has existed a longstanding need for a new and improved type of specialized cutting implement that can be used to trim a candle wick to the proper height prior to lighting the candle, and the provision of such a construction is a stated objective of the present invention.

BRIEF SUMMARY OF THE INVENTION

Briefly stated, the candle wick trimming device that forms the basis of the present invention comprises in general, a pair of complementary generally horizontally disposed severing surfaces which project inwardly at a point disposed proximate to, but spaced from, the lower end of a pair of jaw members which are pivotally secured to one another in a well recognized fashion.

As will be explained in greater detail further on in the specification, the upper end of the jaw members are provided with handle elements and the lower end of the jaw members are provided with flat abutment surfaces which are designed to offer a blunt surface area point of contact on the top of the body of the candle so that the top surface will not become marred during the use of the device.

In addition, the cooperating severing surfaces are spaced rearwardly from the lower end of the jaw members such that when the lower end of the jaw members are pivoted towards one another, the severing surfaces will trim a candle wick at the proscribed height above the top of the body of the candle.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
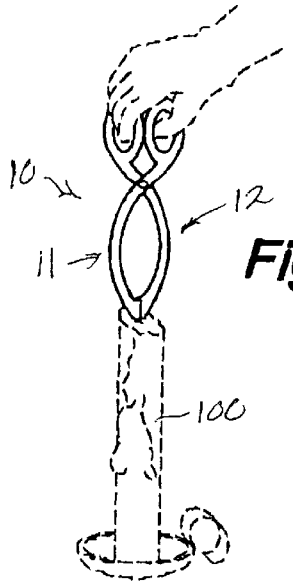
FIG. 1 is a perspective view of the candle wick trimmer device in use.

As can be seen by reference to the drawings, and in particular to FIG. 1, the candle wick trimmer device that forms the basis of the present invention is designated generally by the reference number 10. The device 10 comprises in general, a pair of jaw units 11 and 12. These units will now be described in seriatim fashion.

Figure 2:
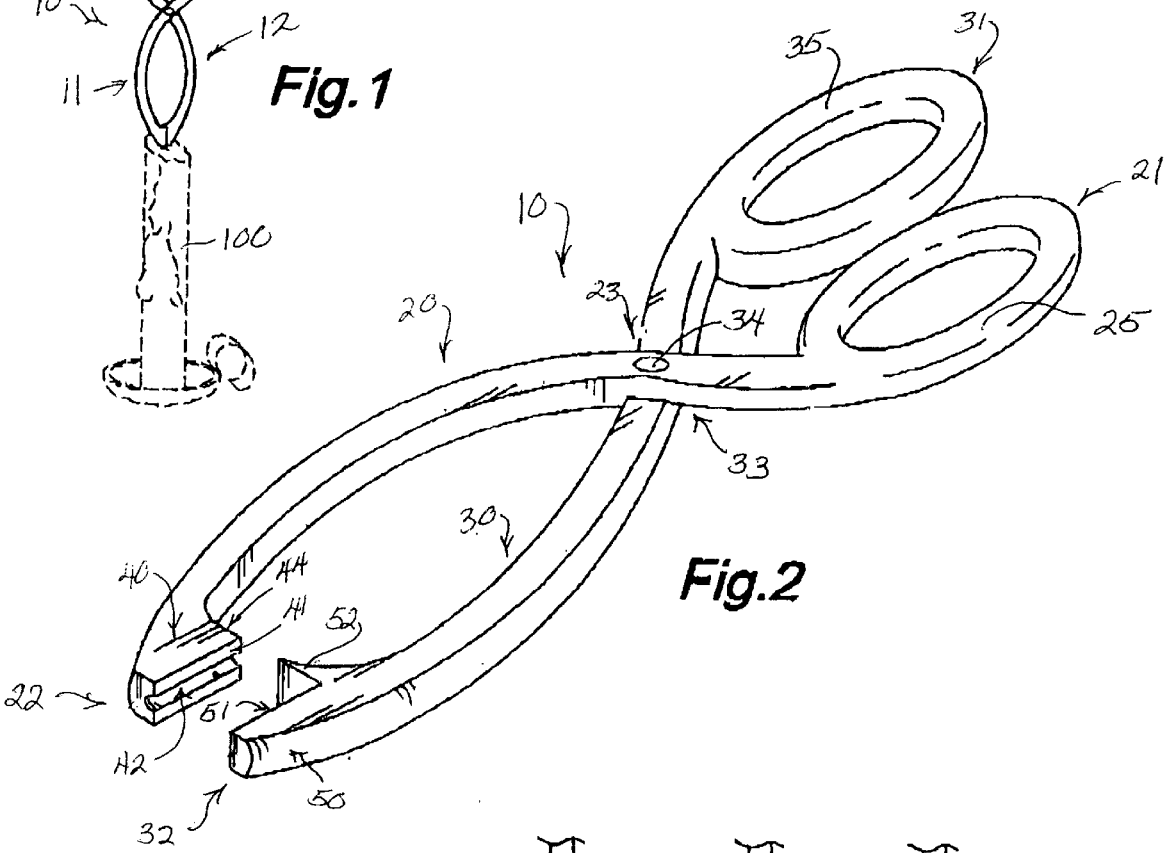
FIG. 2 is an isolated perspective view of the wick trimmer device.

As can best be seen by reference to FIG. 2, each of the jaw units 11, 12 comprises elongated jaw members 20, 30 having upper ends 21, 31 and generally flat lower ends 22, 32. The intermediate portions 23, 33 of the jaw members 20, 30 are pivotally secured to one another at 34 in a well recognized fashion.

As can also be seen by reference to FIG. 2, the upper ends 21, 31 of the jaw members 20, 30 are provided with looped handle elements 25, 35 which are dimensioned to receive a user's fingers in a scissors style fashion. As can further be seen by reference to FIG. 2, one of the jaw members 20 is provided with an enlarged jaw element 40 having an inwardly projecting vertical jaw face 41 provided with an elongated recess 42 that is dimensioned to receive the wick 101 of a candle 100.

Still referring to FIG. 2, it can be seen that the other jaw member 30 is provided with a reduced dimension jaw element 50 provided with a recessed vertical face 51 that is dimensioned to engage the vertical face 41 on the other jaw element 40 to captively engage the wick 101 of a candle.

In addition, the other jaw member 50 is further provided with an inwardly directed tapered severing shelf 52 which is disposed above the recessed vertical face 51. The severing shelf 52 is adapted to slidably engage the upper surface 44 of the enlarged jaw element 40 after the severing shelf 52 has clipped the candle wick 101 at a height of ¼ inch above the candle body 100.

Figure 3:
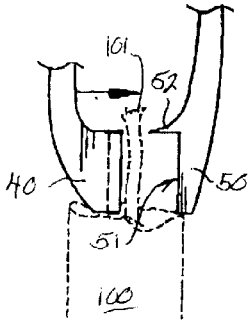
FIG. 3 is an enlarged detail view showing the jaw elements just prior to engagement with a wick.
Figure 4:
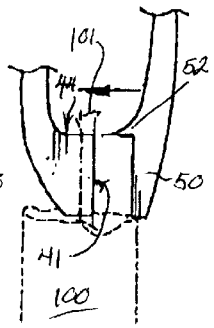
FIG. 4 is an enlarged detail view showing the recessed jaw element engaging the wick.
Figure 5:
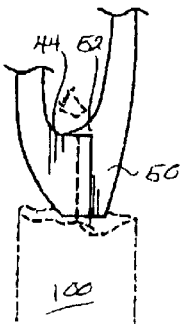
FIG. 5 is an enlarged detail view of the severing jaw element after it has engaged both the wick and the recessed jaw element.

As can best be appreciated by reference to FIGS. 3 through 5, the vertical faces 41, 51 of the jaw elements 40 and 50, respectively, have a vertical height of ¼ inch wherein when the recessed vertical face 41 engages the candle wick 101 and then the severing shelf 52 severs the candle wick 101 as the vertical faces 41, 51 are urged towards one another, the severing action will take place ¼ inch above the body of the candle to produce the ideal wick height.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

What is claimed is:

1. A candle wick trimming device for severing the wick of a candle at a predetermined height above the body of a candle wherein the device comprises:

a pair of equal length jaw units wherein each of the jaw units comprises an elongated jaw member having an upper end provided with looped handle elements, a flat lower end and an intermediate portion pivotally connected to the other elongated jaw member; wherein the lower end of each jaw member is provided with a jaw element having a generally flat vertical face which extends upwardly from the lower end of each jaw member to a point spaced from the lower end of each jaw member and at least one of the jaw members is provided with a vertical recess which extends the length of the vertical face of said at least one jaw member and is dimensioned to receive a portion of a candle wick; and cooperating severing means disposed above the vertical faces on the lower end of the jaw members for severing a candle wick at a predetermined height above the body of a candle.

2. The device as in claim 1 wherein the vertical face of the at least one jaw member has an upper end which terminates in a flat rearwardly extending upper surface and the vertical face of the other jaw member has an upper end which terminates in an outwardly projecting severing shelf which is slidably engageable with said rearwardly extending upper surface.

3. The device as in claim 1 wherein said predetermined height is approximately ¼ inch.

4. The device as in claim 1 wherein said severing shelf is tapered.

* * * * *